US005509873A

United States Patent [19]

Corn

[11] Patent Number: 5,509,873

[45] Date of Patent: Apr. 23, 1996

[54] EXERCISE DEVICE WITH ADJUSTABLE RESISTANCE

[76] Inventor: Joshua A. Corn, 555 E. William Ste. 21C, Ann Arbor, Mich. 48104

[21] Appl. No.: 156,712

[22] Filed: Nov. 24, 1993

[51] Int. Cl.[6] ..... A63B 23/12; A63B 21/16

[52] U.S. Cl. ..... 482/74; 482/127; 482/124

[58] Field of Search ..... 482/120, 74, 103, 482/124, 127, 114, 115, 116, 120, 123; D21/191, 195, 198; 273/187.2, DIG. 21; 119/785, 789

[56] References Cited

U.S. PATENT DOCUMENTS

| | | | |
|---|---|---|---|
| 481,730 | 8/1892 | Miller | 482/127 |
| 885,074 | 4/1908 | Nidever | 482/127 |
| 1,139,126 | 5/1915 | Kerns | 482/127 |
| 1,432,013 | 10/1922 | Blake | 482/124 |
| 1,703,375 | 2/1929 | Volk | 273/187.2 |
| 2,959,414 | 11/1960 | Saltz | 482/127 |
| 3,462,156 | 8/1969 | Gentry | 273/DIG. 21 |
| 3,804,420 | 4/1974 | Boyd | 273/187.2 |
| 4,441,707 | 4/1984 | Bosch . | |
| 4,779,866 | 10/1988 | Marshall et al. | 482/116 |
| 4,944,511 | 7/1990 | Francis | 482/123 |
| 4,948,119 | 8/1990 | Robertson, Jr. | 482/116 |
| 4,961,573 | 10/1990 | Wehrell | 482/124 |
| 5,005,832 | 4/1991 | Van Der Hoeven | 482/124 |
| 5,136,377 | 1/1993 | Wilkinson . | |
| 5,137,272 | 8/1992 | Wilkinson . | |
| 5,234,395 | 8/1993 | Miller et al. | 482/120 |

OTHER PUBLICATIONS

U.S. DOT NHTSA Final Report contract No. DTNH 22-80-C-07052 pp. iii-and 18.

*Primary Examiner*—Richard J. Apley
*Assistant Examiner*—Jerome Donnelly
*Attorney, Agent, or Firm*—Basile and Hanlon

[57] ABSTRACT

An exercise device is provided which is useful as a jogging or aerobics accessory. The device is worn on a belt which fits around the waist of the user. The device features handles attached to retractable cords. As the handles are extended away from the waist of the user, the device provides adjustable resistance.

21 Claims, 5 Drawing Sheets

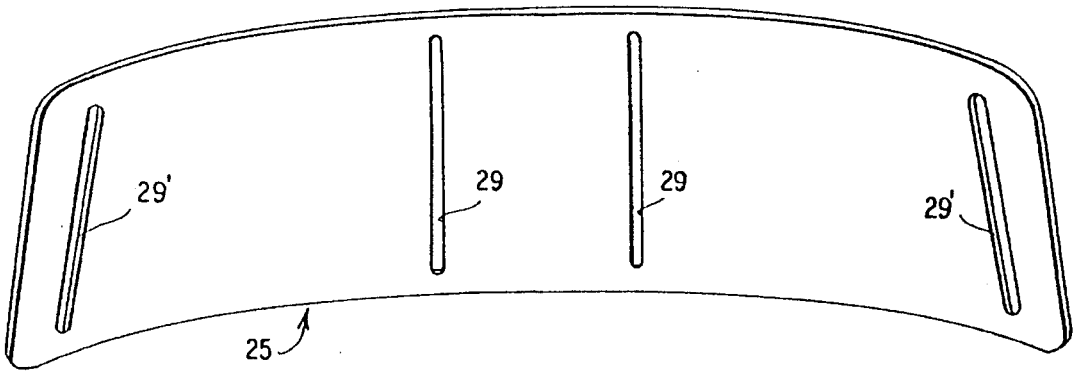
FIG. 5A
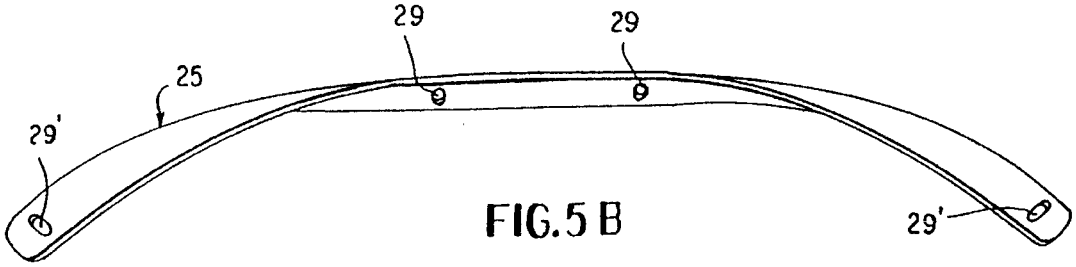
FIG. 5 B
FIG. 6A
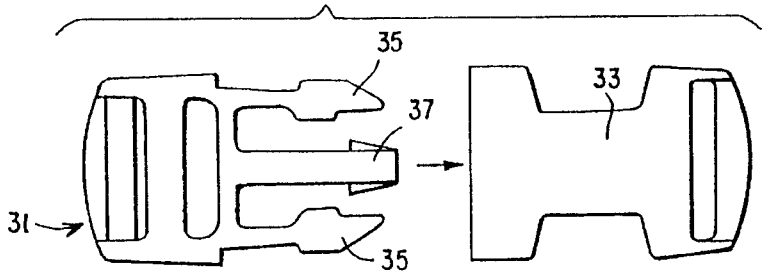
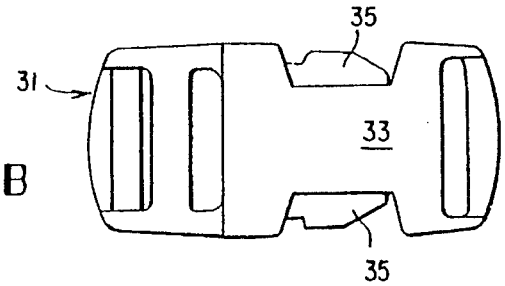
FIG. 6B

EXERCISE DEVICE WITH ADJUSTABLE RESISTANCE

FIELD OF THE INVENTION

This invention relates to an exercise device which is especially useful as an accessory in exercises involving a back-and-forth motion of the arms (i.e., jogging or aerobics), and which provides constant, adjustable resistance to the muscles of the upper body.

BACKGROUND OF THE INVENTION

Various exercise devices have been proposed in the prior art which are intended as accessories in jogging or aerobics. Some of these devices rely on the user to provide resistance. For example, U.S. Pat. No. 4,441,707 (Bosch) discloses an exercise belt for joggers. The belt encircles the waist and houses a flexible line which terminates at each end in a handle. However, this device does not have any means of imparting resistance to the line. Instead, the user must supply his own resistance by pushing forward on one handle while resisting the backward movement of the other handle. Therefore, it is difficult for the user of this device to maintain a consistent resistance throughout the period of use.

Some attempts have been made to provide a workout device which imparts variable resistance to the user. For example, U.S. Pat. No. 5,137,272 (Wilkinson) and U.S. Pat. No. 5,176,377 (Wilkinson) disclose exercise devices to be used for aerobics or walking. These devices rely on elastic cords to provide resistance to the arms and legs of the user. In some embodiments, the devices contain a brake lock which can be used to adjust the resistance of the elastic resistance lines. However, while the brake lock does provide some resistance, the user must still supply additional resistance by pushing forward on one handle while resisting the backward movement of the other handle. In addition, the nature and placement of the elastic cord is such that the resistance provided extends only half way through the extension of the arms. Furthermore, because the device utilizes a single line, it is not possible to exercise one arm independently of the other arm. Finally, the resistance line interfaces with the handles in such a way that the line continually comes into contact with the user's arm during use.

Other devices rely on cables and pulleys to provide resistance. For example, U.S. Pat. No. 4,961,573 (Wehrell) discloses a boxing harness equipped with shoulder straps. The device is worn on the upper body and contains a housing into which a line terminating in handgrips retracts. The housing contains a series of pulleys which provide resistance to the line. The device is optionally fitted with means for making the resistive force selectively adjustable. However, this device is unsuitable for jogging, since it requires the user to hold his hands at chest level, not at waist level, and therefore interferes with the natural stride of a runner. Furthermore, the location of the pulley system directly under the arms of the user causes the pulley system to come into contact with the arms of the user during workout. In addition, because of the location of the harness on the body of the user, the lines are at a small enough angle to the arms of the user to cause them to come into continual contact with the user's arms. Finally, since both handles are attached to the same line, it is not possible to exercise one arm independently from the other or to provide a different resistance to each arm.

The prior art discloses many types of handles used with jogging or aerobics accessories. However, none of the devices known to the art provide handles that exercise the muscles of the hands and provide an additional workout for the muscles of the forearms. For example, the handles on the device disclosed in U.S. Pat. No. 4,961,573 consist of a handpiece, roughly cylindrical in shape, which fits the hand of the user, and which is beaded on a circular loop attached to the elastic line. Because this handpiece-and-loop combination fits securely into the crook of the hand, it is not necessary for the user to squeeze the handgrip to maintain his hold. Consequently, this type of handle provides little workout for the hands and forearms. The handles disclosed in U.S. Pat. No. 4,441,707, which have rigid, U-shaped frames with a grip mounted on the outer, open end suffer from the same infirmity.

In addition, many exercise devices of the prior art have handles which dangle loosely from the device. See, for example, U.S. Pat. No. 4,441,707 (Bosch). This design is undesirable for sports such as jogging or aerobics, since the handles tend to come into contact with the body of the user when the device is not in use.

Finally, none of the handles of the prior art are designed to provide quick release, and are thus unsuitable for safety reasons in sports where falling down is a constant hazard. For example, conventional handles consisting of a handgrip on a loop require the user to retract his hand from the loop before the handle can be released. This creates a hazard for joggers, for example, who need to be able to rapidly extend their hands forward to brace for a fall. Loop-type handles interfere with this motion, possibly causing serious injury.

SUMMARY OF THE INVENTION

The present invention is an exercise device which provides adjustable resistance to the muscles of the upper body and which is especially useful as an accessory in jogging or aerobics and other sports involving a back-and-forth motion of the arms.

One advantage of the exercise device of the present invention is that it provides an even resistance throughout the entire range of motion of the user.

Another advantage of the present invention is that it provides resistance which is easily adjustable, thereby allowing the user to provide for a different degree of difficulty from one workout to the next, or even to adjust the level of difficulty during a workout.

A further advantage of the present invention is that the handle of the device is constructed so that the user must maintain a steady grip on the handles, thereby providing additional exercise for the muscles of the hands and forearms. This construction provides for a more strenuous workout than devices with handles that rest in the crook of the hand and require little gripping action.

Still another advantage of the present invention is that the handle design allows the user to release the handle simply by opening his hand. This is an important safety feature in that it enables the user to rapidly extend his arm forward when necessary to brace for a fall.

Another advantage of the present invention is that the location of the device on the user's waist causes the line to be at a sufficiently large angle to the arms of the user that there is minimal contact between the line and the arms of the user. Contact with the line is also minimized by the construction of the handgrips, which are attached to the line only at one end.

Yet another advantage of the present invention is the orientation of the device on the waist of the user. This orientation provides resistance along the natural pathway of a runner's stride. Furthermore, since the waist is relatively stationary, the location of the device there avoids interference with the natural motion of the user. Finally, this orientation interferes less with the user's circulation than devices that utilize a shoulder harness.

A further advantage of the present invention is the location of the resistance means on the back of the user. This arrangement provides for resistance throughout the entire range of motion. Furthermore, this arrangement precludes any harmful or offensive contact between the arms of the user and the resistance means.

Yet another advantage of the present invention is that the cables are retractable. This provides resistance for the arms on both the forward and backward swings.

Still another advantage of the present invention is that the handles snap into holders situated on the user's side. This, coupled with the retractability of the cables, prevents the device from interfering with the user's movement when the device is not in use.

A further advantage of the present invention is that it provides a separate resistance means for each arm. This feature allows the user to exercise one arm at a time or to provide a different degree of resistance for each arm, a feature particularly desirable for rehabilitation purposes.

Another advantage of the present invention is that it provides a reflector on the back of the user, thus making the user more visible to road traffic at night.

Further advantages of the present invention will be apparent from the following description.

BRIEF DESCRIPTION OF THE DRAWINGS

FIG. 5A is a front view showing the preferred embodiment of the contoured backplate;

FIG. 5B is a top view showing the preferred embodiment of the contoured backplate;

FIG. 6A is an exploded front view of the preferred embodiment of the fastening means of the present invention in its unattached position;

FIG. 6B is a front view of the preferred embodiment of the fastening means of the present invention in its attached position;

PREFERRED EMBODIMENTS OF THE INVENTION

FIGS. 1–4 illustrate the preferred embodiment of the exercise device of the present invention. As FIGS. 1–3 indicate, the device comprises dual cylinders i which are horizontally disposed and are fastened to a belt 3. Each cylinder terminates in a tension-driven spool 5 on one end and a tension adjustment knob 7 on the other. The spools are attached to the cylinder by means of a slidable bolt assembly 9 or other suitable fixing means which secures the spools to the cylinder without interfering with their rotation.

Figure 2:
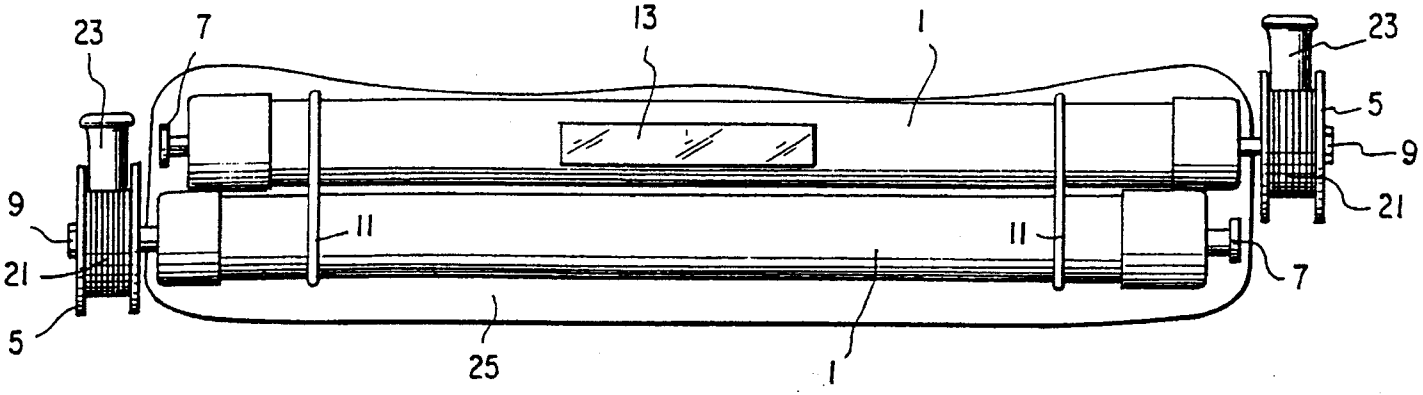
FIG. 2 is a back view of the preferred embodiment of the present invention.

As FIG. 2 shows, the cylinders are situated so that the ends terminating in a spool are opposite each other. The cylinders are bound together by a nylon band 11 or other suitable binding means, and may be adorned with reflectors 13 and other devices designed to make the user more visible at night.

Figure 1:
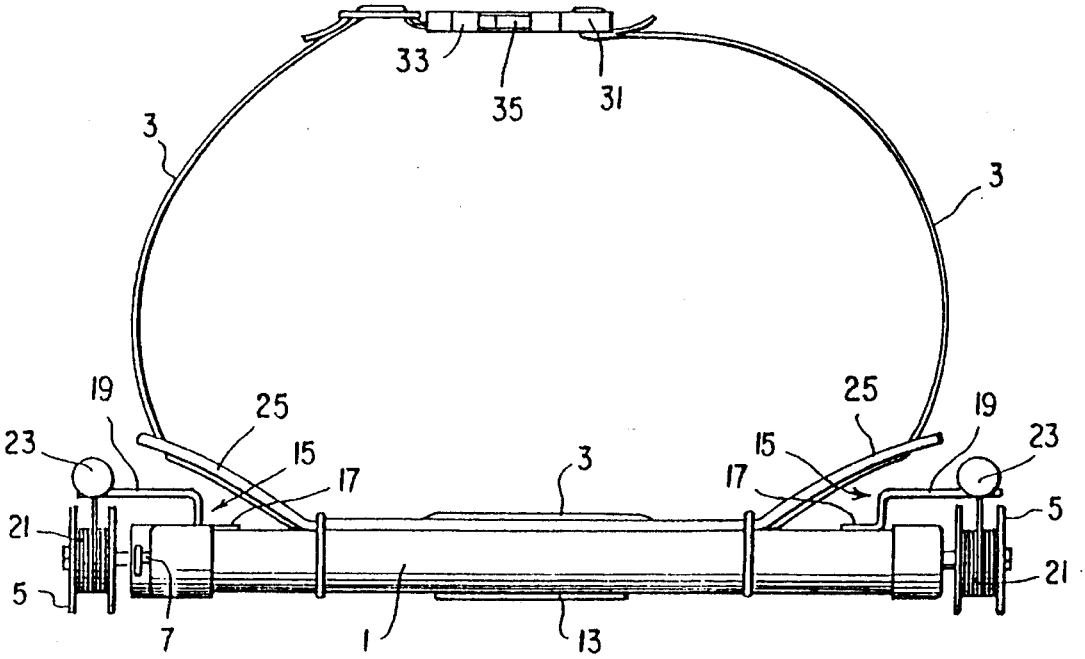
FIG. 1 is a top view of the preferred embodiment of the present invention.
Figure 3:
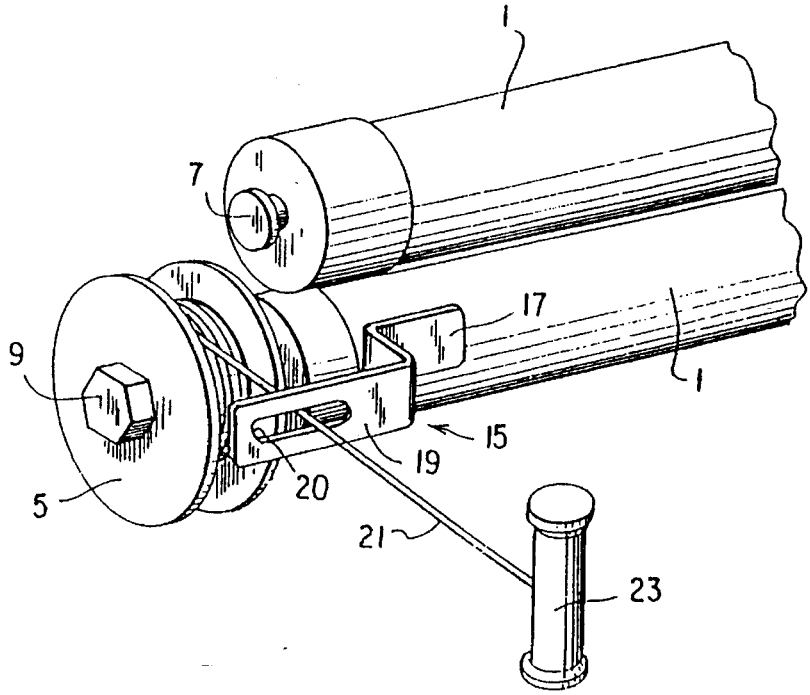
FIG. 3 is a partial perspective side view of the preferred embodiment of the resistance means of the present invention.

As indicated in FIG. 3, the end of the cylinder terminating in a spool is further equipped with an s-shaped cord guide 15. The cord guide terminates at one end in a fixing plate 17, and terminates at the other end in a guide plate 19. The fixing plate secures the cord guide to the side of the cylinder immediately adjacent to the spool. The guide plate is equipped with a hole 20 through which the cord 21 extends. The guide plate feeds the cord onto the spool in the proper orientation, regardless of the angle at which the cord is retracting with respect to the spool. The guide plate further serves to support the handles 23 when the device is not being used. A clip, not shown, may also be provided to removably secure the handles to the belt when the device is not in use.

Figure 4:
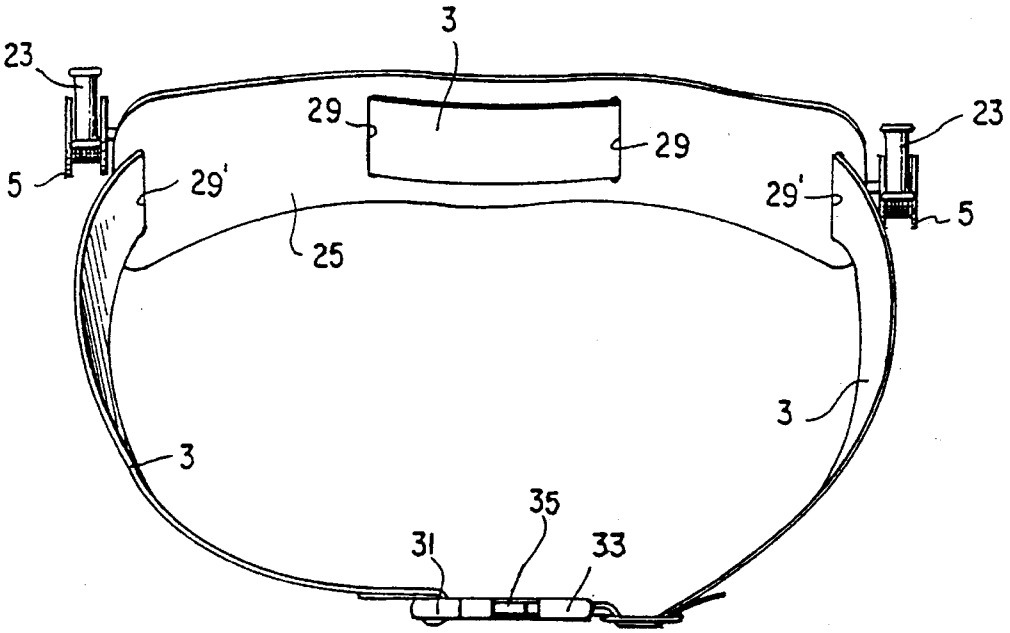
FIG. 4 is a perspective front view of the preferred embodiment of the present invention.

As indicated in FIG. 4, the exercise device of the present invention includes a belt 3 which fits around the waist of the user and which holds the cylinders in the proper orientation. The belt supports a contoured backplate 25 which provides cushioning between the back of the user and the cylinders. The belt is removably secured around the user's waist by a buckle or other suitable fastening means, and may be adjusted to accomodate different users. Furthermore, the backplate is movable along the belt, allowing it to be centered to the user's preference. Optionally, the belt may be adorned with pouches, clips, reflectors, and other accessories.

The contoured backplate is shown in detail in FIGS. 5A and 5B. The backplate is provided with slits 29 and 29' through which the belt is fitted. The backplate is preferably made out of leather or some other durable material that is sufficiently pliable to mold to the back of the user and to provide user comfort. Other materials may also be added to the backplate to provide additional comfort or sweat absorbency.

The preferred embodiment of the buckle is shown in FIGS. 6A and 6B, and consists of a fork 31 which locks into a receptacle 33. The fork has two outer prongs 35 and an inner prong 37. The outer prongs protrude from the sides of the receptacle, thus allowing for easy disengagement of the fork. In the preferred embodiment, the fastening means is made out of a durable, impact-resistant plastic.

The handles 23, as best seen in FIG. 3, of the present invention are contoured to fit the hand of the user. While any suitable handle may be used with the present device, it is preferred that the handle is roughly cylindrical. The cord is attached at one end to the handle. This construction provides for greater exercise of the muscles of the hands and forearms than loop-and-bobbin type handles, since the user must apply a constant grip on the handle during use.

Figure 7A:
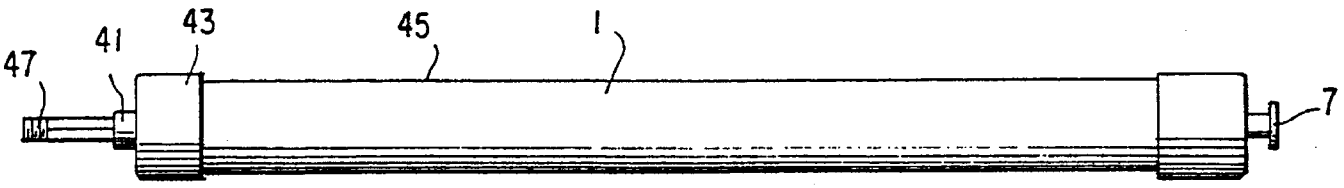
FIG. 7A is a front view of the preferred embodiment of the resistance means of the present invention.
Figure 7B:
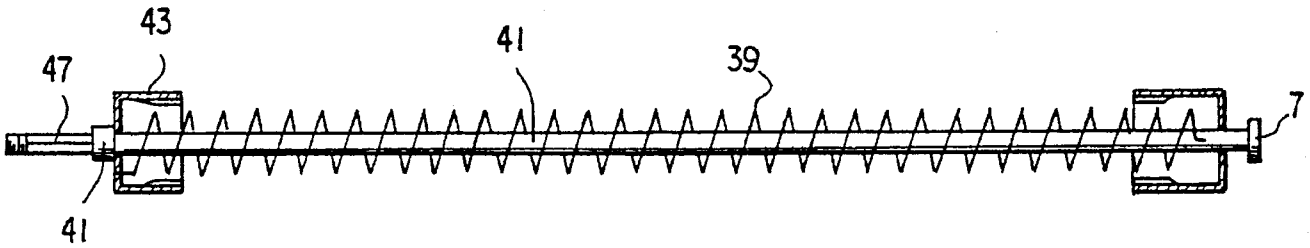
FIG. 7B is a front view of the preferred embodiment of the resistance means of the present invention with the outer shell removed.

FIGS. 7A and 7B illustrate a preferred method by which resistance is imparted to the cord. The interior of each cylinder is equipped with a spring coil 39 which is helically disposed around a plastic rod 41. The coil is held in place on one end by a round metal plate 43 and on the other end by the tension adjustment knob. The round metal plate fits into grooves or perforations in the exterior shell 45 of the cylinder. The tension adjustment knob similarly attaches in a similar fashion to the exterior shell of the cylinder. The plastic rod protrudes from the round metal plate, where it is capped with a metal tip 47. The metal tip protrudes through the interior of the annulus of the spool and is affixed to the spool by a bolt 9 or other appropriate fastening means.

The plastic rod is capable of rotating about its axis. As the cord is extended away from the cylinder, it rotates the spool, which in turn rotates the plastic rod. As the plastic rod rotates, it forces the spring coil into a compact position, and the spring coil resists further rotation of the rod. When tension is no longer applied to the spool, as when the user retracts his arm towards his body, the spring expands, thereby rotating the spool in the reverse direction until sufficient cord has been wound up to take up the slack.

The tension adjustment knob operates by twisting one end of the spring in such a way that the spring is more compact in its relaxed position. As a result, a greater amount of energy is required to extend the cord, since this involves further compression of the already compressed spring.

Figure 8A:
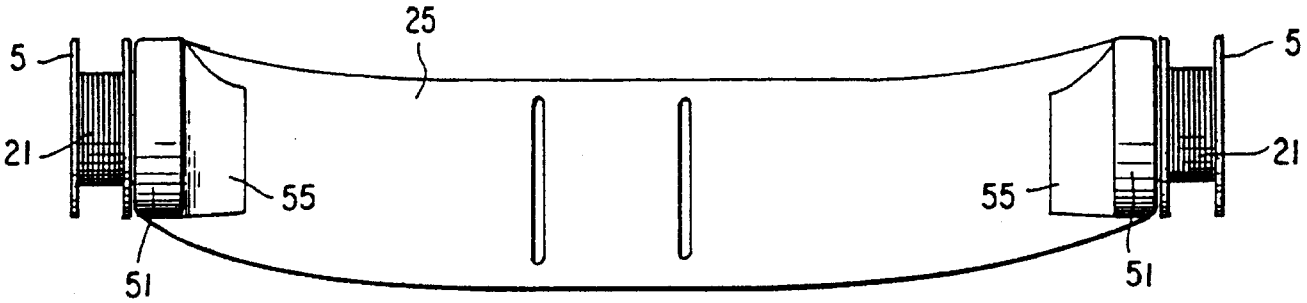
FIG. 8A is a rear view of a second embodiment of the resistance means shown attached to the contoured backplate.
Figure 8B:
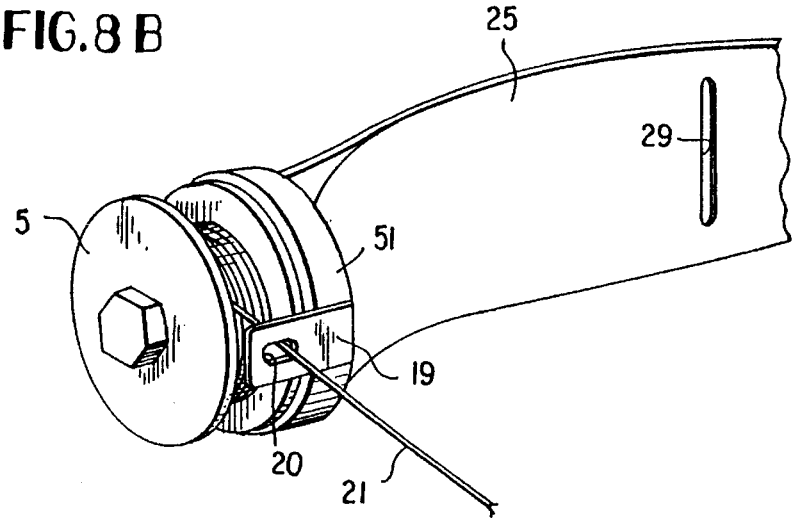
FIG. 8B is a front view of the second embodiment of the resistance means shown attached to the contoured backplate.

FIGS. 8A and 8B illustrate another method by which resistance may be imparted to a cord. Here, the resistance means is in the form of a disc coil 51 which is interfaced with the spool assembly. The disc coil is housed in a circular casing 53, preferably plastic, which is attached by means of a bracket 55 to the belt.

Figure 9A:
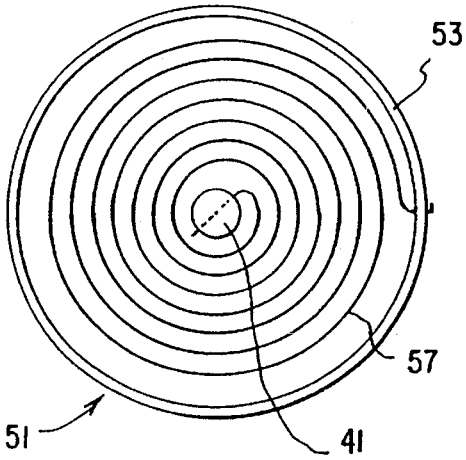
FIG. 9A is a side view of the second embodiment of the resistance means of the present invention.
Figure 9B:
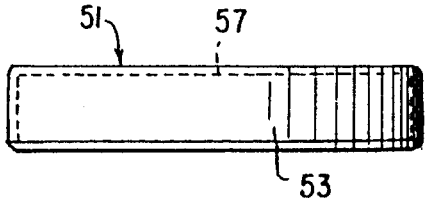
FIG. 9B is a top view of the second embodiment of the resistance means of the present invention.
Figure 9C:
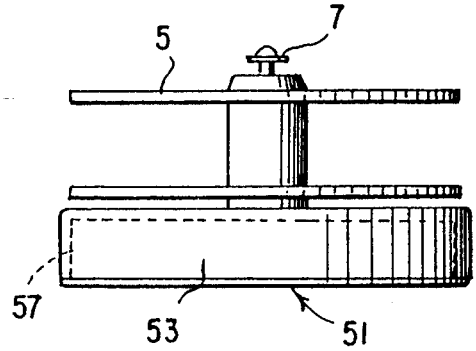
FIG. 9C is a top view of the second embodiment of the resistance means of the present invention illustrating how the resistance means interfaces with the spool.

FIGS. 9A, 9B, and 9C show the disc coil resistance means in greater detail. The circular housing covers a coil of metal tape 57 which is attached at one end to the plastic rod at a point where the plastic rod protrudes through the casing. The metal tape is coiled somewhat loosely within the housing. As the cord is extended by the user, the spool rotates, which in turn causes the plastic rod to rotate. As the plastic rod rotates, the metal tape is drawn to the center of the housing, causing the coil to deform. The metal tape is of sufficient rigidity to resist deformation, thereby providing resistance to the cord. The coil also has sufficient memory so that, when tension is subsequently removed from the cord, the coil returns to its original shape and position, causing the spool to rotate in the reverse direction and to take up any slack in the cord.

As with the rod-type resistance means, the disc coil can be supplied with a tension adjustment knob 7. The tension adjustment knob operates by twisting one end of the coil in such a way that the coil is more compact in its relaxed position. As a result, a greater amount of energy is required to extend the cord, since this involves further compression of the already compressed coil.

The following is intended as an illustration of the use of the present invention as a jogging accessory.

In use, the user straps the device around his waist prior to running. The belt may be adjusted to provide a snug fit that does not cut off circulation. The user then grasps the handles firmly in his hands and begins running in a normal jogger's stride. At each instant, the spools adjust rapidly to increased tension or slack in the line, providing a uniform resistance to the motion of the user's arms. If the user desires, he may turn the tension adjustment knob to increase or decrease the amount of resistance in the line. If the user reaches a point in his workout where the device is no longer needed, he need only secure the handles in their clips; the device is designed to be close to the user's hips, and will not interfere with the remaining workout.

Modifications within the scope of the appended claims will be apparent to those skilled in the art.

I claim:

1. An exercise device useful as an accessory in running or aerobics, comprising:

(a) a plurality of inelastic, retractable cords, each terminating in a handgrip;

(b) retracting means for retracting said cords;

(c) separate, adjustable resistance means for providing resistance to each of said cords, as said cords are being withdrawn from said retracting means wherein said resistance means operate independently of each other; and (d) support means for supporting said retracting means on the waist of the user.

2. The device of claim 1, wherein each said cord is attached to only one end of said handgrip, and wherein said handgrip is roughly cylindrical in shape.

3. The device of claim 2, wherein said handgrip is contoured to fit the shape of the user's hand.

4. The device of claim 1, wherein said support means is further equipped with reflecting means for rendering the user more visible to motorists at night.

5. The device of claim 1, wherein said retracting means is a tension-driven spool.

6. The device of claim 1, wherein said resistance means comprises a helically wound spring coil.

7. The device of claim 1, wherein said resistance means comprises a disc coil.

8. The device of claim 1, wherein said support means further comprises fastening means for removably fastening said support means around the waist of the user.

9. The device of claim 1, further comprising:

feeding means for feeding said cord onto said retracting means in the proper orientation, regardless of the angle at which the cord is extended away from said retracting means.

10. The device of claim 1, wherein said handgrip is contoured to fit the shape of the user's hand.

11. The exercising device of claim 6, wherein said coil is helically disposed about a longitudinal rod that extends substantially across the back of the user.

12. The exercising device of claim 11, further comprising:

a cylindrical housing disposed about said rod.

13. The exercise device of claim 12, wherein the cylindrical housings of each of said resistance means are mounted in parallel on said support means.

14. The exercise device of claim 13, wherein said retracting means comprises a spool disposed on one end of each of said resistance means.

15. The exercise device of claim 14, wherein the spools on adjacent resistance means are disposed on opposing ends of said resistance means.

16. The exercise device of claim 11, wherein said retracting means is a spool connected to one end of said rod.

17. The exercise device of claim 12, wherein said support means comprises a belt and a contoured backplate slidably disposed on said belt, and wherein said cylindrical housing is attached to said backplate by a plurality of annular bands.

18. The exercise device of claim 1, wherein said support means comprises:

a belt; and a backplate slidably disposed on said belt, said backplate being contoured to the back of the user.

19. The exercise device of claim 18, wherein said resistance means is a disc coil.

20. The exercise device of claim 19, wherein said disc coil is attached to said backplate by means of a metal bracket which is attached to said disc coil and which is equipped with a flange that protrudes through a slit in said backplate.

21. The exercise device of claim 18, wherein said belt is inserted through vertical slits in said backplate.

* * * * *